US009062680B2

(12) United States Patent
Lin et al.

(10) Patent No.: US 9,062,680 B2
(45) Date of Patent: Jun. 23, 2015

(54) DUAL CHANNEL COMPLIANT TURBINE PUMP

(71) Applicant: Crane Pumps & Systems, Inc., Piqua, OH (US)

(72) Inventors: Chih M. Lin, Tipp City, OH (US); William J. Watkins, Tipp City, OH (US); Bruce B. Ordway, Troy, OH (US)

( * ) Notice: Subject to any disclaimer, the term of this patent is extended or adjusted under 35 U.S.C. 154(b) by 473 days.

(21) Appl. No.: 13/621,905

(22) Filed: Sep. 18, 2012

(65) Prior Publication Data

US 2015/0104288 A1 Apr. 16, 2015

(51) Int. Cl.
*F04D 1/00* (2006.01)
*F04D 5/00* (2006.01)

(52) U.S. Cl.
CPC . *F04D 1/00* (2013.01); *F04D 5/008* (2013.01)

(58) Field of Classification Search
CPC ..... F04D 5/002; F04D 5/008; F04D 23/008
USPC ..... 415/55.1; 417/423.3
See application file for complete search history.

(56) References Cited

U.S. PATENT DOCUMENTS 8,267,640 B1 * 9/2012 Lin et al. ..... 415/55.1

* cited by examiner

*Primary Examiner* — Richard Edgar
(74) *Attorney, Agent, or Firm* — Standley Law Group LLP

(57) ABSTRACT

A pump has a housing that defines a pump chamber (200) with a fluid inlet and outlet (26, 28). An impeller (30) is mounted for rotation in the pump chamber. A raceway (40) is in floating axial relationship with the impeller and divides the pump chamber into an inlet chamber (202), an impeller chamber (204) and a discharge chamber (206). The raceway has preferably two flow channels, in separated end-to-end arrangement. Each flow channel has an inlet passage and an outlet passage, establishing a fluid conduit from the inlet chamber to the impeller chamber and then to the discharge chamber. A spring (60) provides resistance to axial movement of the raceway away from the impeller. A seal chamber (42) formed on the raceway and pressurized by the fluid, urges the raceway towards the impeller.

19 Claims, 3 Drawing Sheets

CROSS SECTION VIEW OF COMPLIANT TURBINE PUMP

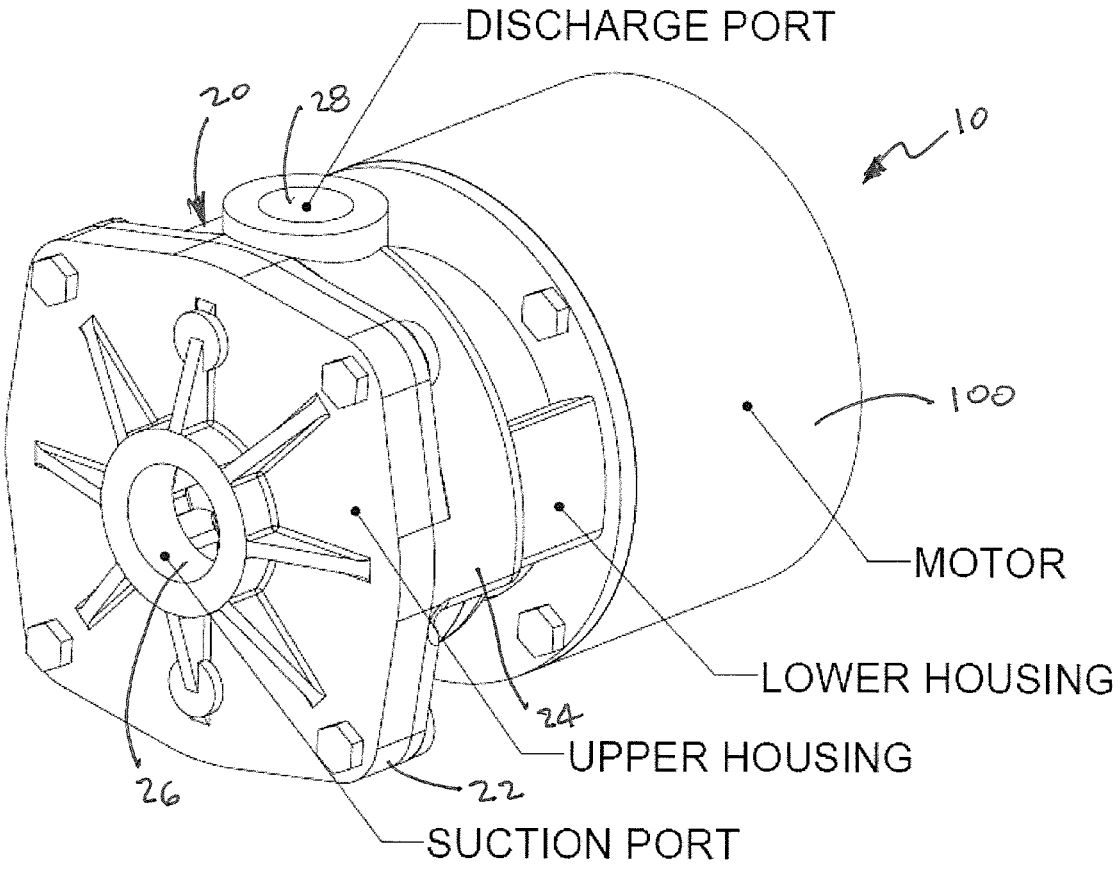
FIGURE 1. ISO VIEW OF COMPLIANT TURBINE PUMP

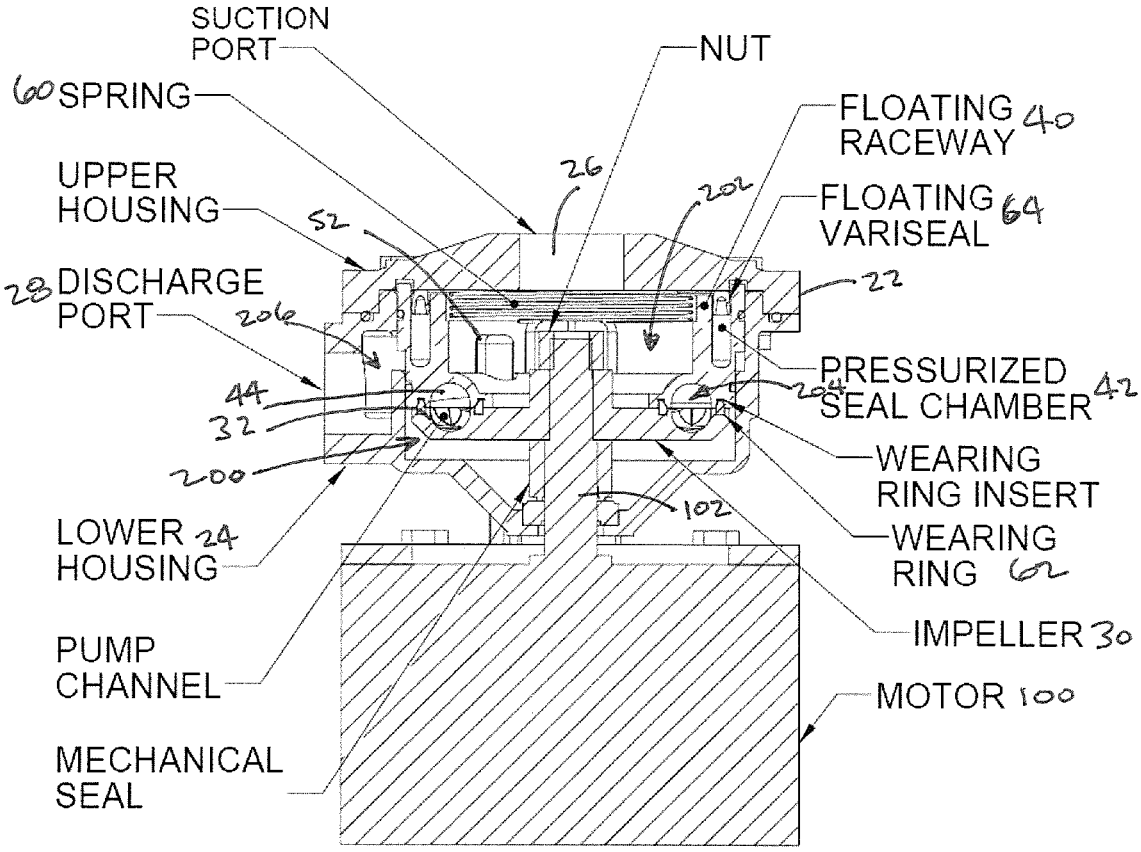
FIGURE 2. CROSS SECTION VIEW OF COMPLIANT TURBINE PUMP

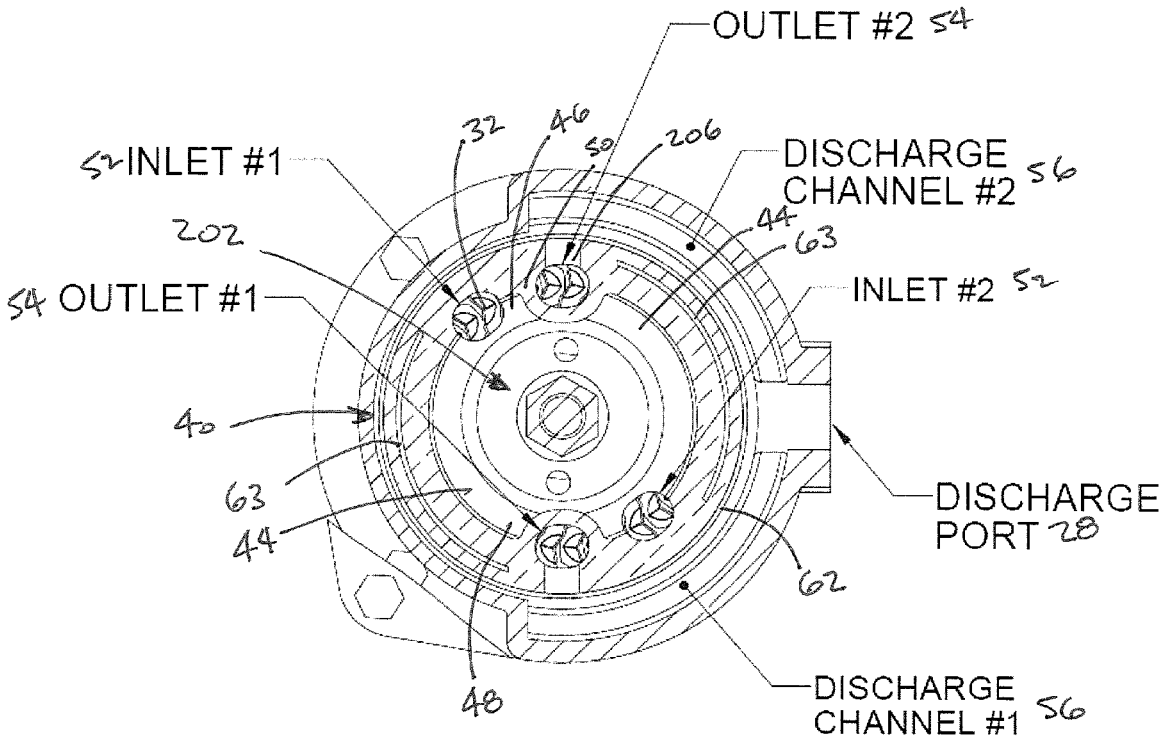
FIGURE 3. FLOW PATHS OF DUAL CHANNELS COMPIANT TURBINE PUMP

DUAL CHANNEL COMPLIANT TURBINE PUMP

CROSS-REFERENCE TO RELATED APPLICATIONS

This application is a non-provisional application and claims no benefit of a right of priority.

TECHNICAL FIELD

The present invention relates to pumps, specifically a regenerative turbine pump with a compliant dual-channel floating raceway.

BACKGROUND OF THE ART

Regenerative turbine pumps are one of many types of pumps that have the capability to deliver fluid from one location to another. Typically, a pump transfers energy into a fluid flow system in order to overcome some differential pressure, moving fluid in the system from lower pressure to higher pressure. Normally, regenerative turbine pumps add energy to the system by adding centrifugal force and shearing action to the fluid.

Regenerative turbine pumps close a void between centrifugal and positive displacement pumps. Generally, a regenerative turbine pump includes an impeller that has a multiplicity of impeller vanes in series. In a regenerative turbine pump, fluid travels in a unique circulatory flow pattern through vanes of the impeller. Fluid travels in multiple cycles through several vanes of a turbine impeller, whereas fluid only passes once through a centrifugal impeller. Preferably, turbine impeller vanes impart a centrifugal force outward toward the impeller periphery, which pushes the fluid into a circulatory flow pattern. The circulatory flow patterns of fluid within the impeller vanes may be accurately compared to a helical spring, where opposite ends of the spring are bent in a circle around a given axle until they connect. Under such a description, a pump operation under low head would yield increasing space between the helical coils, whereas a pump operation under high head would yield decreasing space between the helical coils. The circulatory flow within the impeller vanes occurs while the entire impeller revolves in an annular channel. Recirculation of liquid among the vanes of a turbine impeller occurs several times between suction and discharge. As the fluid repeatedly circulates, the flow inside of the vanes generates increasing fluid velocity. The kinetic energy associated with the fluid velocity may be utilized to increase the flow velocity and/or pressure of the fluid. Multiple cycles of fluid recirculation in the impeller vanes to build fluid velocity is known as "regeneration."

Many times, regenerative turbine pumps are used in applications that have high head pressure and low fluid flow characteristics. Generally, in situations with very high head pressure and low fluid flow, the pump is susceptible to leakage. Therefore, very tight internal tolerances are typically required between the impeller and raceway to reduce the leakage within the pump.

Some regenerative turbine pumps do not have any adjustable features used in parallel with a selected-fit between the impeller and a fixed raceway to achieve and maintain the tight tolerances required for adequate performance of the pump. Generally, the raceway navigates fluid into the impeller and provides a channel, through which liquid travels as it is propelled by the impeller. However, after use in the field, the impeller, the raceway, and/or the sealing means used to between them may gradually wear due to frictional fluid flow, causing the clearance between the impeller and the raceway to increase. Consequently, pump performance would suffer and in order to regain optimal performance characteristics, the instrument would require costly and time-consuming adjustments of the pump clearances.

The known prior art lacks a pump that does not require a select fit between the raceway and the impeller; a pump that can automatically compensate for wear; and a pump that does not require field adjustment of the pump clearances after installation to maintain desired tolerances between the impeller and raceway. Accordingly, a pump is desired which provides an inexpensive means to eliminate the costly selected fit of the impeller with the raceway. Furthermore, it is desired to provide a pump which is self-adjusting to maintain a constant state of compliance.

SUMMARY OF THE INVENTION

An object of the present invention is to eliminate the need for an axial adjustment device while still maintaining an appropriate clearance between the raceway, wearing rings, and impeller. It is also an object to eliminate the need to adjust the pump clearances between the impeller and the raceway to regain desired performance characteristics.

Accordingly, it is the object of the present invention to automatically compensate for wear on pump elements—such as the raceway, wearing rings, and impeller—caused by common forces during use—e.g. frictional fluid flow. A turbine pump that automatically compensates for wear forces will contribute to eliminating the need for field adjustment of pump clearances.

Another object of the present invention is to reduce the cost to manufacture regenerative turbine pumps by reducing the need for selected fit of the impeller with the raceway.

An exemplary embodiment of the present invention provides for a dual channel compliant turbine pump. Contained in the upper housing of the turbine pump is a suction port, which draws fluid into the pump. On top of a spinning impeller sits a raceway that floats axially relative to the impeller, although it does not rotate or move radially. The raceway remains compliant with the turbine impeller due to forces imposed by a pressurized seal chamber. Intake fluid from the suction port flows into a plurality of fluid inlet passages that are located atop the raceway.

Fluid flows through the inlet passages into the pump channels and circulates within the several vanes of the spinning impeller. The present invention provides for a plurality of fluid outlet passages, located on the lower surface of the floating raceway. Fluid circulating within the impeller vanes either enters one of a plurality of discharge channels, or recycles into the seal chamber.

An embodiment of the present invention provides for a corresponding number of discharge channels and outlet passages. Output flow leaving the turbine impeller through the discharge channels converges and exits the pump at the discharge port. Output flow being recycled pressurizes the seal chamber to maintain compliance with variable pump loading conditions. For example, at a light load condition, the pressure in the seal chamber is low. Due to the low pressure, an exemplary embodiment of the present invention only applies a light downward force upon the raceway. In turn, the raceway exerts minimal force against the wearing rings and impeller. By applying lesser force upon the raceway during light load conditions, the lives of the wearing rings and impeller are maximized. At a heavy load condition, the pressure in the seal chamber is high. Consequently, the high pressure applies a heavy downward force to the raceway, causing the raceway to tightly seal the pump channels, which maximizes pump efficiency.

One principal advantage of this device is that it eliminates a need to manually adjust the pump clearances by realigning the impeller with the raceway so as to maintain desired tolerances required for adequate performance of the pump. An additional advantage of the present invention includes reducing maintenance costs associated with adjusting the pump clearances. Furthermore, some exemplary embodiments may reduce manufacturing costs associated with selectively fitting the impeller and raceway. Additionally, exemplary embodiments may reduce wear on the raceway and/or the impeller, the amount of starting torque required, and the pressure loss due to defective tolerances between the raceway and the impeller. Exemplary embodiments may simplify field repair by reducing the number of components requiring replacement—notably, the present invention may reduce the frequency at which wearing rings are replaced. Also, exemplary embodiments may improve pump performance by reducing pressure loss within the pump.

BRIEF DESCRIPTION OF THE DRAWINGS

Other aspects of the present invention will be readily apparent from the following descriptions of the drawings and exemplary embodiments, wherein identical reference numerals refer to identical parts, and wherein:

FIG. 1 is a perspective view of an embodiment of the pump, operatively attached to a motor;

FIG. 2 is an axial cross-sectional view of the FIG. 1 embodiment; and

FIG. 3 is a radial cross-sectional plan view of the FIG. 1 embodiment, taken through the raceway.

DETAILED DESCRIPTION OF THE EXEMPLARY EMBODIMENTS

FIG. 1 is a perspective view of an embodiment of a pump 10 exemplifying the inventive concept. In this view, the pump 10 has a housing 20 with first and second housing parts 22, 24. The pump 10 also has a fluid inlet and a fluid outlet for handling fluid entering and exiting the pump. In the depicted embodiment, the fluid inlet is a suction port 26 on the first housing part 22 and the fluid outlet is a discharge port 28 on the second housing part 24. The suction port 26 is arranged for axial entry of the fluid into a pump chamber (not shown in FIG. 1) defined by the housing 20 and the discharge port 28 provides a radial exit of the fluid. Some embodiments of the pump 10 allow for reversible flow in which the fluid enters the discharge port 28 and exits the suction port 26. When used in the manner described herein, a fluid, preferably an incompressible fluid, is pressurized by passing the fluid through the pump 10. As illustrated in FIG. 1, the respective ports 26, 28 are integrally formed in the housing 20. Each port 26, 28 will typically be adapted for attachment of fluid conduits (not shown) to supply and remove the fluid being acted upon.

The housing 20 of the pump 10 may not be arranged in the same two housing parts 22, 24 in all embodiments, but the need for maintenance will require access to the pump chamber, within which the operative features of the pump are located. Material selection for the housing 20 and its parts will be readily known to one of skill.

A further feature of the pump 10 is the motor 100 that is shown in operative engagement with the second housing part 24, which is adapted for such a removable engagement with the motor. The motor 100 provides torque, by means of a drive shaft (not shown in FIG. 1), to rotate an impeller (also not shown) contained in the pump chamber.

FIG. 2 is a cross-section taken through the axis of an impeller 30 that is mounted for rotation in the pump chamber 200 formed by housing parts 22, 24. In FIG. 2, the motor 100 and an associated drive shaft 102, which extends into the pump chamber 200, are not shown in any particular detail, as they are conventional and will be readily understood. Impeller 30 is operatively mounted for rotation on the shaft 102, and the details of the mount are not considered a part of the invention, as they will be known to those of skill. Impeller 30 will generally be of a conventional design for use in a regenerative turbine pump, so the impeller will preferably have a groove bearing vanes 32, usually on only one face thereof.

A raceway 40 is also located in the pump chamber 200, and, in FIG. 2, is seen as being directly above the impeller 30. While the raceway 40 is positioned around the drive shaft 102, it is not connected to the drive shaft and does not receive torque therefrom. Instead, the raceway 40 floats axially above the rotating impeller 30 and, as a result of the structures that will be described, it is maintained in a compliant condition with desired pump clearances due to the interaction of a biasing means and a seal chamber 42, which is a part of the raceway. The raceway 40 effectively divides the pump chamber 200 into an inlet chamber 202, an impeller chamber 204 and a discharge chamber 206. These respective chambers 202, 204, 206 are sequentially in fluid communication and, indeed, define a fluid path through the pump 10.

The preferred biasing means that acts to maintain the compliance of the raceway 40 is depicted as a spring 60. This spring 60 is arranged in the inlet chamber 202 between the raceway and the housing and the spring bears against both. Preferably, the spring 60 is preloaded to help maintain a desired clearance between the raceway 40 and the impeller 30. Further, the spring 60 provides resistance against axial movement of the raceway 40 away from the impeller 30, which will occur as the pump 10 is operated. The spring 60 is preferably positioned in a manner which limits any radial movement during operation.

It is preferred to interpose at least one wear means, such as wear ring 62 between the raceway 40 and the impeller 30, to maintain a minimum axial spacing. Such a wear ring 62 may be seated in a set of corresponding grooves in the opposing faces of the raceway 40 and the impeller 30. As will be better seen in FIG. 3, it may be desirable to place other wear means 63 on the raceway 40.

Further understanding of FIG. 2 and particularly the raceway 40 shown there, additional attention is now directed to FIG. 3, which provides a cross-sectional plan view through the raceway. During the preferred operation, an incompressible fluid enters the pump 10 through the suction port 26 into the inlet chamber 202.

Some description has been provided of a first surface of the raceway 40 that faces the impeller 30. At least two flow channels 44 are provided on this first surface, with exactly two flow channels being depicted. These flow channels 44 are preferably arranged generally end-to-end around the face of the raceway 40, along an arc at a fixed radial distance from an axis of the impeller 30. Typically, and without intending to limit, the arc selected for the flow channels will lie in the range of from about 25 to about 75% of the radial dimension of the impeller 30, to be able to lengthen the fluid contact without interfering with wear ring 62, which will preferably be near the radial edge of the impeller and the raceway 40. The flow channels 44 are preferred to be located directly opposite any vanes 32 that are provided on the impeller 30, to maximize the benefit thereof. In the depicted embodiment, each of the flow channels 44 has a first end 46 and a second end 48. An area of angular separation 50 occupies a zone between the first end of one flow channel and the second end of the other. This separation is intended to minimize, as much as possible, flow of fluid from one flow channel into the other. While it may be possible to place more than two flow channels around a given arc, the number of flow channels is probably limited to no more than about four or five, simply due to this separation. Two flow channels 44 may in fact be preferred, due to the ability to balance out the effects obtained in the seal chamber 42.

Fluid entering the inlet chamber 202 obtains access to one of the flow channels 44 though an inlet passage 52 that is associated with the flow channel. Ideally, the fluid is equally splitting into portions corresponding to the number of flow channels.

The inlet passage 52 passes through the raceway 40 and terminates at the first end 46 of the flow channel 44, so it communicates the fluid to the impeller chamber 204. While the raceway 40 does not rotate, the flow of fluid in the flow channel 44 is restricted, particularly in the radial direction, and momentum transfer through the fluid from the rapidly moving vanes occurs. The net movement of the fluid is down the length of the flow channel 44, until it reaches the second end 48 of the flow channel. At that point, the fluid encounters an outlet passage 54 that restricts the volume through which the fluid flows and lifts it away from the flow channel 44, thus translating fluid velocity into pressure.

Before the now-pressurized fluid is discharged into a discharge chamber 206 associated with the flow channel 44, the fluid is placed in communication with the seal chamber 42, to avail the pump of the increased pressure.

As seen best in FIG. 2, the seal chamber 42 surrounds the radial boundary of the raceway 40 on the face that is opposite the impeller 30. A seal means, preferably a spring-energized polymeric seal 64, such as a product sold commercially under the trademark VARISEAL, is seated in a floating manner in the seal chamber 42 and maintains the pressure of the seal chamber imparted by the pressurized fluid.

It is clearly preferred to have the raceway 40 make no more than a gentle engagement of the impeller 30 during rotation thereof, to minimize the wear of the raceway 40. It is also preferred that the gap between the raceway 40 and the impeller 30 remain small enough to effect of the impeller. The size of the gap will fluctuate, however, depending on the load conditions encountered by the pump 10. For example, at a light load condition, the pressure in the seal chamber 42 will be low, and it will apply only a light downward force on the raceway 40, which minimizes wear on the raceway, the wear ring 62 and the impeller 30. At heavy load condition, the pressure in the seal chamber 42 is increased and the seal chamber applies a greater downward force on the raceway 40, maximizing pump 10 efficiency. Any contact between the raceway 40 and the impeller 30 should be insufficient enough to cause significant wear therebetween. Hence, the force applied by the seal chamber 42 on the raceway 40 automatically adjusts with the pump load.

Referring again to FIG. 3, the pressurized fluid from each outlet passage 54 enters the discharge chamber 206, as defined by a discharge channel 56 associated with the flow channel 44. A confluence of pressurized fluid in the discharge channels 56 occurs in the discharge chamber 206 and the fluid exits through the discharge port 28.

Preferably, during operation of the pump 10, the clearance between the raceway 40 and the impeller 30 is negligible to efficiently focus pump system energy into kinetic energy form. During ideal operation, the outlet passages 54 constrict the volume through which fluid flows, thus increasing pressure of the output fluid. Preferably, the pressurized seal chamber 42 substantially balances the hydraulic net force exerted against both faces of the raceway 40. Therefore, the seal chamber 42 exerts a pressure that ideally maintains a constant ratio to the fluid flow pressure exiting the discharge port 28, so the raceway 40 maintains compliance under varying load conditions, ensuring desirable clearance between the floating raceway 40 and impeller 30. This should alleviate the expensive adjustment of the motor shaft device found in numerous other regenerative turbine pumps that use a fixed raceway.

What is claimed is:

1. A pump, comprising:

a housing, defining a pump chamber therewith, the housing having a fluid inlet to, and a fluid outlet from, the pump chamber;

an impeller, mounted for rotation about an axis thereof in the pump chamber;

a raceway, in floating axial relationship with the impeller in the pump chamber, the raceway effectively dividing the pump chamber into an inlet chamber, an impeller chamber and a discharge chamber, the raceway comprising:

on a surface thereof facing the impeller, at least two flow channels, arranged in a separated end-to-end manner along an arc at a fixed radial distance from an axis of the impeller;

an inlet passage and an outlet passage for each flow channel, the inlet passage providing a fluid conduit through the raceway from the inlet chamber to a first end of the flow channel and the outlet passage providing a fluid conduit from a second end in the flow channel to a discharge channel associated with the discharge chamber;

a seal chamber, formed on the first surface and pressurized by fluid from the outlet passage, the pressure in the seal chamber urging the raceway towards the impeller; and a means for resisting axial movement of the raceway away from the impeller.

2. The pump of claim 1, wherein:

the housing comprises a first and a second housing part, the fluid inlet comprising a suction port arranged on the first housing part and the fluid out let comprising a discharge port arranged on the second housing part.

3. The pump of claim 2, wherein:

with reference to the impeller axis, the suction port is axial and the discharge port is radial.

4. The pump of claim 2, further comprising:

a drive shaft on which the impeller is mounted, the drive shaft entering the housing through the second housing part and adapted for operative attachment to a motor.

5. The pump of claim 1, wherein:

the means for resisting axial movement comprises a spring located in the inlet chamber between the raceway and the housing.

6. The pump of claim 5, wherein:

the spring is preloaded to help maintain a desired clearance between the raceway and the impeller.

7. The pump of claim 1, further comprising:

at least one wear means, interposed between the raceway and the impeller to maintain an axial separation thereof.

8. The pump of claim 1, wherein:

the impeller comprises a plurality of vanes on a face thereof directed towards the raceway.

9. The pump of claim 1, wherein:

a seal means, interposed between the seal chamber and the housing, maintains the pressure in the seal chamber.

10. The pump of claim 1, wherein:

with reference to the impeller axis, the suction port is axial and the discharge port is radial.

11. A pump, comprising:

a housing, defining a pump chamber within the housing, the housing comprising a suction port and a discharge port communicated to the pump chamber;

an impeller, mounted on a drive shaft for rotation in the pump chamber;

a raceway, in floating axial relationship with the impeller in the pump chamber, the raceway effectively dividing the pump chamber into an inlet chamber in fluid communication with the fluid inlet , an impeller chamber and a discharge chamber in fluid communication with the fluid outlet, the raceway comprising:

a first surface, facing the impeller and defining therewith the impeller chamber;

a second surface, opposite the first surface, facing the fluid inlet of the housing and defining therewith the inlet chamber;

at least two flow channels formed in the second surface as a part of the impeller chamber, the flow channels arranged in a separated end-to end manner along an arc at a fixed radial distance from an axis of the drive shaft;

an inlet passage and an outlet passage for each flow channel, the inlet passage providing a fluid conduit through the raceway from the inlet chamber to a first end of the flow channel and the outlet passage providing a fluid conduit from a second end in the flow channel to a discharge channel associated with the discharge chamber;

a seal chamber, formed on the first surface and pressurized by fluid from the outlet passage, the pressure in the seal chamber urging the raceway towards the impeller; and a means for resisting axial movement of the raceway away from the impeller, the movement-resisting means preloaded to help maintain a desired clearance between the raceway and the impeller.

12. The pump of claim 11, wherein:

the housing comprises a first and a second housing part, the suction port arranged on the first housing part and the discharge port arranged on the second housing part.

13. The pump of claim 12, wherein:

with reference to the impeller axis, the suction port is axial and the discharge port is radial.

14. The pump of claim 12, wherein:

the drive shaft enters the housing through the second housing part and is adapted for operative attachment to a motor.

15. The pump of claim 11, wherein:

the movement-resisting means comprises a spring located in the inlet chamber between the raceway and the housing.

16. The pump of claim 11, further comprising:

a wear ring, engaged between the first surface of the raceway and the impeller.

17. The pump of claim 11, wherein:

the impeller comprises a plurality of vanes on a face thereof directed towards the first surface of the raceway.

18. The pump of claim 11, further comprising:

a spring energized polymeric seal, interposed between the seal chamber and the housing to maintain the seal chamber pressure.

19. A method for pressurizing an incompressible fluid, using a pump of claim 1, the method comprising the steps of:

inserting the fluid into the fluid inlet of the pump;

splitting the fluid into first and second portions, the first portion passing from the inlet chamber into the first of two flow channels in the impeller chamber and the second portion passing from the inlet chamber into the second of two flow channels in the impeller chamber;

pressurizing the first and second fluid portions in the impeller chamber by rotating the impeller;

removing the pressurized first and second fluid portion from the impeller chamber through the outlet passages of the respective flow channels, while pressurizing the seal chamber with the pressurized first and second fluid portions;

collecting the pressurized first and second fluid portions in the discharge chamber, providing a pressurized fluid ; and discharging the pressurized fluid through the fluid outlet.

* * * * *